US005482370A

United States Patent [19]

Dedoes

[11] Patent Number: 5,482,370

[45] Date of Patent: Jan. 9, 1996

[54] PAINT CAN COVER ASSEMBLY

[75] Inventor: John T. Dedoes, Walled Lake, Mich.

[73] Assignee: Dedoes Industries, Inc., Walled Lake, Mich.

[21] Appl. No.: 263,784

[22] Filed: Jun. 22, 1994

[51] Int. Cl.[6] ..... B01F 7/20

[52] U.S. Cl. ..... 366/247; 366/286; 366/605

[58] Field of Search ..... 366/247, 279, 366/285, 286, 249, 250, 251, 254, 605

[56] References Cited

U.S. PATENT DOCUMENTS

| | | | |
|---|---|---|---|
| 2,269,736 | 1/1942 | Rogers | 366/247 |
| 3,041,052 | 6/1962 | Dedoes | 366/247 |
| 4,407,584 | 10/1983 | Boudin | 366/605 |
| 5,094,543 | 3/1992 | Mursa | 366/605 |
| 5,368,389 | 11/1994 | Dedoes | 366/247 |

*Primary Examiner*—Robert W. Jenkins
*Attorney, Agent, or Firm*—Gifford, Krass, Groh, Sprinkle, Patmore, Anderson & Citkowski

[57] ABSTRACT

A cover assembly is provided for a paint can. The cover assembly includes a lid which is dimensioned to overlie the open top of the paint can and the lid includes a spout for dispensing paint from the can. Locking feet detachably secure the lid to the paint can chime. The cover assembly further includes a stirring assembly having an elongated shaft which extends through the lid so that a lower end of the shaft is positioned within the interior of the paint can while an upper end of the shaft extends upwardly above the lid. A paddle is secured to the lower end of the shaft so that rotation of the shaft stirs the paint within the paint can. A driven member is secured to the upper end of the shaft and this driven member cooperates with a drive mechanism in a paint can rack. Furthermore, a resilient locking dog is mounted to the driven member which cooperates with transversely extending and axially spaced slots formed along the drive shaft. The cooperation between the locking dog and the shaft slot enables the driven member to be axially manually adjusted by the user and, when positioned to its adjusted actual position, the locking dog locks the driven member to the shaft against axial movement.

9 Claims, 1 Drawing Sheet

PAINT CAN COVER ASSEMBLY

BACKGROUND OF THE INVENTION

1. Field of the Invention

The present invention relates to paint can cover assemblies of the type used in automatic mixing systems.

2. Description of the Prior Art

There are a number of previously known cover assemblies for paint cans. These previously known cover assemblies are designed to overlie the open top of the paint can and are secured to the paint can chime by locking feet. Furthermore, many of these cover assemblies include spouts and closure assemblies associated with the spouts to allow the paint to be dispensed from the can.

These previously known cover assemblies further included a mixing assembly. Typically, the mixing assembly included an elongated shaft extending through the paint can lid so that a lower end of the shaft was positioned within the interior of the paint can while an upper end of the shaft extended upwardly above the paint can lid. A paddle was secured to the lower end of the shaft while a driven member is secured to the upper end of the shaft.

These previously known paint can assemblies are typically used with automatic stirring equipment of the type used in automotive body repair shops and the like. Such paint stirring equipment includes a rack in which the paint cans with their attached cover assemblies are positioned. Furthermore, once the paint cans are positioned within the paint can rack, a drive member in the rack engages and cooperates with the driven member to rotatably drive the driven member with its attached paddle as long as the paint can is positioned within the rack. In this fashion, the paint cans can be stored indefinitely within the rack while insuring that the paint remains in a stirred and thus a ready to use condition.

In order for the driven member on the cover assembly to cooperate with the drive member in the paint rack, it is necessary that the driven member when attached to the paint can is vertically positioned at the proper height so that the driven member can mechanically engage and cooperate with the drive member from the paint can rack. Consequently, it is oftentimes necessary to adjust the axial position of the driven member relative to the shaft in order that the driven member on the shaft properly meshes and cooperates with the drive member from the paint can rack.

Previously, a simple set screw is threaded radially through the driven member against a flat formed in the shaft. In order to adjust the position of the driven member on the shaft, the set screw is loosened by a screw driver, repositioned to the desired position, and then retightened.

There are several disadvantages to the adjustment means for these previously known driven members. One disadvantage is that it is necessary to have the proper tool, i.e. a screw driver, in order to adjust the position of the driven member relative to its shaft. Oftentimes a screw driver is not readily available.

A still further disadvantage of these previously known adjustment means for the driven member is that frequently several adjustments often are required in order to properly position the driven member on its shaft. Each such adjustment requires that the Allen screw be loosened, the driven member readjusted, and the screw retightened. This is time consuming and, therefore, disadvantageous.

SUMMARY OF THE PRESENT INVENTION

The present invention provides a cover assembly for a paint can which overcomes all of the above mentioned disadvantages of the previously known devices.

In brief, the cover assembly of the present invention comprises a lid and locking feet which detachably secure the lid to the paint can so that the lid overlies the open top of the paint can. A spout is also provided on the lid for dispensing paint from the paint can.

An elongated shaft is rotatably positioned to the lid so that a lower end of the shaft is positioned within the interior of the can while an upper end of the shaft projects upwardly from the top of the lid. A paddle is secured to the lower end of the shaft so that rotation of the shaft stirs the contents of the paint can.

A driven member is secured to the upper end of the shaft so that the driven member is positioned above the paint can lid. This driven member, in turn, cooperates with a drive member in the rack of automatic stirring equipment of the type used in automotive body shops.

Unlike the previously known driven members, however, the axial position of the driven member relative to the shaft can be manually positioned by the user without tools and, once axially adjusted to the desired position, automatically locked against further axial movement. In the preferred embodiment, the shaft includes a plurality of transversely extending and axially spaced slots formed along the upper end of the shaft. A resilient locking dog in turn is secured to the driven member and includes a detent which nests and is received within one of the slots on the shaft and, in doing so, locks the driven member against axial movement relative to the shaft. The locking dog, however, is constructed of a resilient material such that the driven member can be manually moved along the shaft and, in doing so, the locking dog deflects between a radially inner position and a radially outer position to enable the locking dog detent to move from one shaft slot to the next shaft slot.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENT OF PRESENT INVENTION

Figure 1:
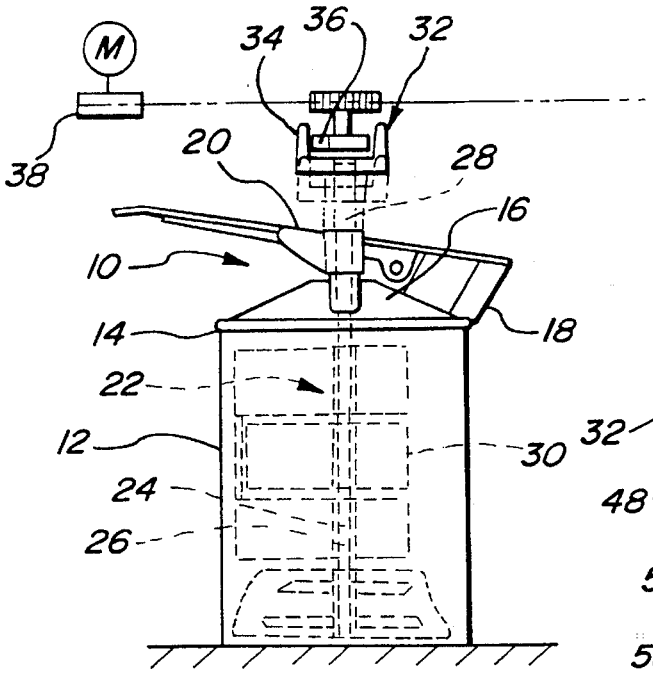
FIG. 1 is a side view illustrating a preferred embodiment of the present invention.

With reference first to FIG. 1, a preferred embodiment of the cover assembly 10 of the present invention is thereshown for use with a paint can 12. The paint can 12 includes an open top 14 having an inwardly extending chime (not shown).

The cover assembly 10 includes a lid 16 dimensioned to overlie the open top 14 of the paint can 12. The lid 16 includes a spout 18 for dispensing paint from the can 12 while locking feet 20 selectively secure the lid 16 to the paint can 12.

Still referring to FIG. 1, a stirring assembly 22 having an elongated shaft 24 is rotatably mounted to the lid 16. A lower portion 26 of the shaft 24 extends within the interior of the paint can 12 while an upper end 28 of the shaft 24 extends above the lid 16. A paddle 30 is secured to the lower end 26 of the shaft 24 so that rotation of the shaft 24 rotatably drives the paddle 30 and stirs the paint within the can 12.

The cover assembly 10 of the present invention is intended to be used in automatic stirring equipment of the type used in automotive body shops. As such, the cover assembly 10 includes a driven member 32 which is secured to the upper end 28 of the shaft 24. The driven member 32 includes, for example, a pair of ears 34 which cooperate with a drive member 36 in the automatic paint stirring rack 38 (illustrated only diagrammatically). Consequently, with the paint can 12 positioned within the rack so that the drive member 36 and driven member 32 drivingly engage each other, the paint within the paint can 12 is continuously stirred.

In order to insure the proper driving engagement between the drive member 36 and driven member 32, it is oftentimes necessary to adjust the axial position of the driven member 32 relative to the shaft 24.

Figure 2:
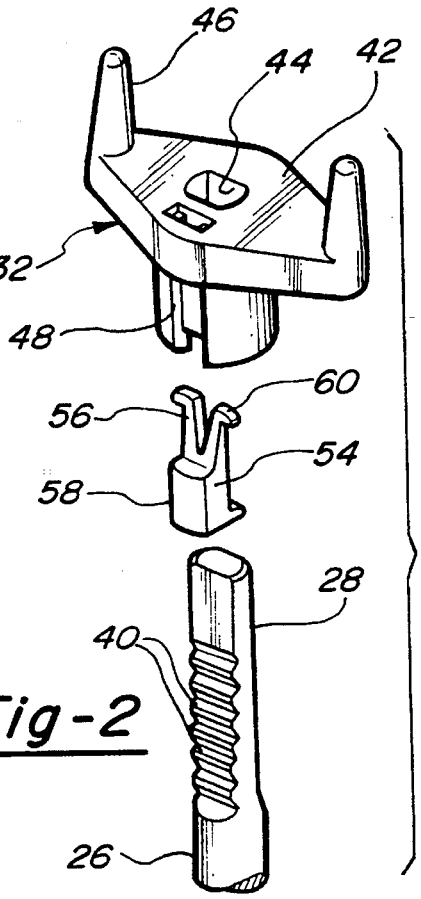
FIG. 2 is an exploded fragmentary view illustrating a portion of the preferred embodiment of the present invention.
Figure 3:
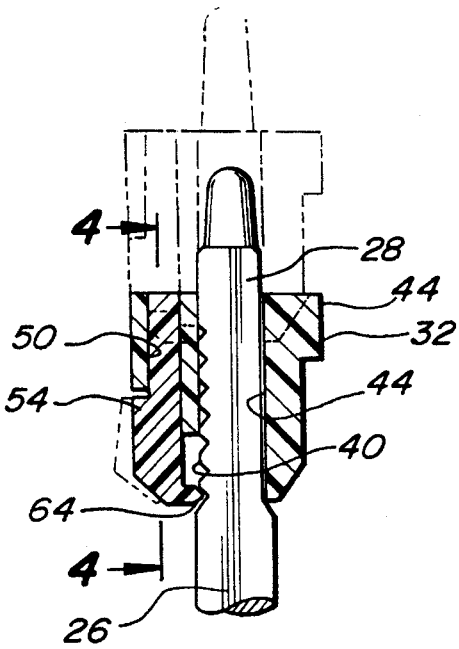
FIG. 3 is a longitudinal sectional view illustrating the preferred embodiment of the present invention.
Figure 4:
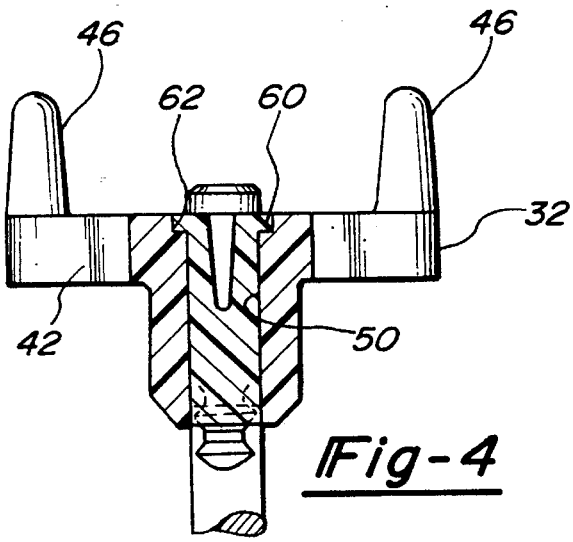
FIG. 4 is a sectional view taken along line 4—4 in FIG. 3.

With reference then to FIGS. 2–4, a preferred embodiment of the means for adjustably securing the driven member 32 to the upper end 28 of the shaft 24 is thereshown in which the upper end 28 of the shaft 24 has a plurality of axially spaced and transversely extending slots 40 formed near the upper end 28 of the shaft 24. As best shown in FIG. 3, these slots 40 are substantially V-shaped in cross section.

The driven member 32 includes a body 42 having a throughbore 44 through which the upper end 28 of the shaft 24 extends. Furthermore, both the throughbore 44 and upper end 28 of the shaft 24 are non-circular in cross sectional shape so that, with the shaft 24 positioned through the body throughbore 44 as shown in FIGS. 3 and 4, rotation of the driven member 32 simultaneously rotatably drives the shaft 24. The body 42 also includes a pair of upwardly extending ears 46 which cooperate with the drive mechanism 36 (FIG. 1) in the paint can rack.

Referring again to FIGS. 2–4, an axially extending slot 48 is formed along one side of the body 42 and this slot 48 terminates in a channel 50 (FIG. 3) in the body 42 of the driven member 32. Both the channel 50 and slot 48 extend generally axially along the driven member 32.

As best shown in FIGS. 2 and 3, a locking dog 54 has an upper portion 56 which is slidably received through the channel 50 to the position shown in FIG. 3. In doing so, a lower portion 58 of the locking dog 54 is positioned within the body slot 48. The upper portion 56 of the locking dog 54 also includes a pair of opposed locking tabs 60 which engage recesses 62 (FIG. 4) formed in the body 42 in order to secure the locking dog 54 to the body 42 of the driven member 32.

With reference now especially to FIG. 3, a radially inwardly extending detent 64 is formed at its lowermost end of the locking dog 54 and the detent 64 which is dimensioned so that it is nestingly received within one of the transverse slots 40 formed on the shaft 24. Furthermore, the locking dog 54 is constructed of a resilient material, such as plastic, nylon or the like so that the locking dog 54 is movable between the radially outer or unlocked position, illustrated in phantom line in FIG. 3, and the radially inner or locked position, illustrated in solid line in FIG. 3.

The locking dog 54 is sufficiently flexible so that the driven member 32, together with the locking dog 54, can be manually axially moved relative to the shaft 24. Such manual movement of the driven member 32 causes the locking dog 54 to flex between its locked and unlocked position as the locking dog detent 64 sequentially registers and is received within the adjacent slots 40 on the shaft 24. However, upon release of the driven member 32, the locking dog detent 64 resiliently engages and rests within one of the slots 40 thereby automatically locking the driven member 32 against further axial movement to the drive shaft 24.

From the foregoing, it can be seen that the present invention provides a cover assembly for a paint can for use with automatic stirring equipment in which the driven member 32 on the cover assembly 10 can be easily manually axially adjusted on the shaft 24 and, upon release, automatically locked into position. All this can be achieved, furthermore, without the use of tools. Furthermore, adjustment of the driven member 32 along the shaft 24 can be rapidly accomplished.

Having described my invention, however, many modifications thereto will become apparent to those skilled in the art to which it pertains without deviation from the spirit of the invention as defined by the scope of the appended claims.

I claim:

1. A cover assembly for a paint can having an open top and an inwardly extending chime, said cover assembly comprising:

a lid dimensioned to overlie the open top of the paint can, said lid having a spout, means for detachably securing said lid to the paint can so that said lid overlies the open top of the paint can, means for stirring the contents of the paint can, said stirring means comprising an elongated shaft, means for rotatably mounting said shaft to said lid so that an upper end of said shaft extends above said lid and a lower end of said shaft extends into an interior of the paint can, and a paddle secured to said lower end of said shaft, a driven member, and means for manually axially adjustably lockingly securing said driven member to said upper end of said shaft, wherein said shaft has plurality of axially spaced notches, and wherein said securing means comprises a locking dog carried by said driven member, said locking dog having a detent which is resiliently urged toward said shaft and nestingly received in one of said shaft notches.

2. The invention as defined in claim 1 wherein said driven member comprises a body having a throughbore through which said shaft extends and a pair of spaced apart ears, said ears adapted to be driven by a drive mechanism.

3. The invention as defined in claim 1 and comprising means for attaching said locking dog to said driven member, wherein said means for attaching said locking dog to said driven member comprises a pair of opposed locking tabs on said locking dog, said locking tabs being received within recesses formed on said driven member.

4. The invention as defined in claim 1 wherein said driven member includes an axially extending slot, said locking dog being positioned within said driven member slot.

5. The invention as defined in claim 4 wherein said locking dog is constructed of plastic.

6. The invention as defined in claim 4 wherein said slot registers with a bore formed in said driven member, an upper portion of said locking dog being positioned within said bore, said upper detention of said locking dog being secured against movement to said driven member.

7. The invention as defined in claim 1 wherein said shaft has a plurality of axially spaced and transversely extending notches, and wherein said securing means comprises a locking dog radially flexibly mounted to said driven member between a radially outer position in which said driven member is freely slidable along said shaft and a radially inner position in which a portion of said locking dog is positioned within one of said notches to thereby prevent axial movement of said driven member relative to said shaft.

8. The invention as defined in claim 1 wherein said shaft notches extend transversely across one side of said shaft.

9. A cover assembly for a paint can having an open top and an inwardly extending chime, said cover assembly comprising:

a lid dimensioned to overlie the open top of the paint can, said lid having a spout, means for detachably securing said lid to the paint can so that said lid overlies the open top of the paint can, means for stirring the contents of the paint can, said stirring means comprising an elongated shaft, means for rotatably mounting said shaft to said lid so that an upper end of said shaft extends above said like and a lower end of said shaft extends into an interior of the paint can, and paddle secured to said lower end of said shaft, a driven member, and means for manually axially adjustably lockingly securing said driven member to said upper end of said shaft wherein said shaft has a plurality of axially spaced and transversely extending notches, and wherein said securing means comprises a locking dog radially flexibly mounted to said driven member between a radially outer position in which said driven member is freely slidable along said shaft and a radially inner position in which a portion of said locking dog is positioned within one of said notches to thereby prevent axial movement of said driven member relative to said shaft.

* * * * *

UNITED STATES PATENT AND TRADEMARK OFFICE

CERTIFICATE OF CORRECTION

PATENT NO. : 5,482,370
DATED : January 9, 1996
INVENTOR(S) : John T. Dedoes

It is certified that error appears in the above-indentified patent and that said Letters Patent is hereby corrected as shown below:

Column 6, line 6, delete "like" and insert --lid--.

Signed and Sealed this

Thirtieth Day of April, 1996

Bruce Lehman

*Attest:*

BRUCE LEHMAN

*Attesting Officer*

*Commissioner of Patents and Trademarks*